United States Patent [19]

Kohn

[11] 3,972,968

[45] Aug. 3, 1976

[54] USE OF HOT BUOYANT LIQUID TO CONVERT PITCH TO CONTINUOUS CARBON FILAMENT

[75] Inventor: Edward M. Kohn, Philadelphia, Pa.

[73] Assignee: Sun Oil Company of Pennsylvania, Philadelphia, Pa.

[22] Filed: Nov. 21, 1974

[21] Appl. No.: 525,690

[52] U.S. Cl. ..... 264/29.2; 264/178 F; 264/DIG. 19; 423/447.8

[51] Int. Cl.[2] ..... B01D 47/00; C01B 31/00; C01B 31/02; C01B 31/04

[58] Field of Search ..... 264/29, 178 F, DIG. 19; 423/447

[56] References Cited

UNITED STATES PATENTS

| | | | |
|---|---|---|---|
| 3,347,959 | 10/1967 | Engelke et al. | 264/37 |
| 3,448,185 | 6/1969 | Sims | 264/178 F |
| 3,461,197 | 8/1969 | Lemelson | 264/178 |
| 3,508,871 | 4/1970 | Corg | 423/447 |
| 3,595,946 | 7/1971 | Joo et al. | 264/29 |
| 3,755,526 | 8/1973 | Watanabe | 264/178 F |

*Primary Examiner*—Jay H. Woo

*Attorney, Agent, or Firm*—J. Edward Hess; Donald R. Johnson; Anthony Potts, Jr.

[57] ABSTRACT

Suitable pitch is formed into a filament continuously and upward by various means located at the bottom of a vessel containing a hot buoyant liquid. The liquid buoys up the fragile filament as it ascends the vessel from a lower region held at one temperature to an upper region where the temperature is about 450°–700°C. The filament emerges upward out of the liquid to move further through a still higher temperature (>900°C) zone which upon leaving the previously formed pitch is a carbon filament. The liquid can be a blend of suitable molten inorganic salts or a molten inorganic oxide.

28 Claims, 1 Drawing Figure

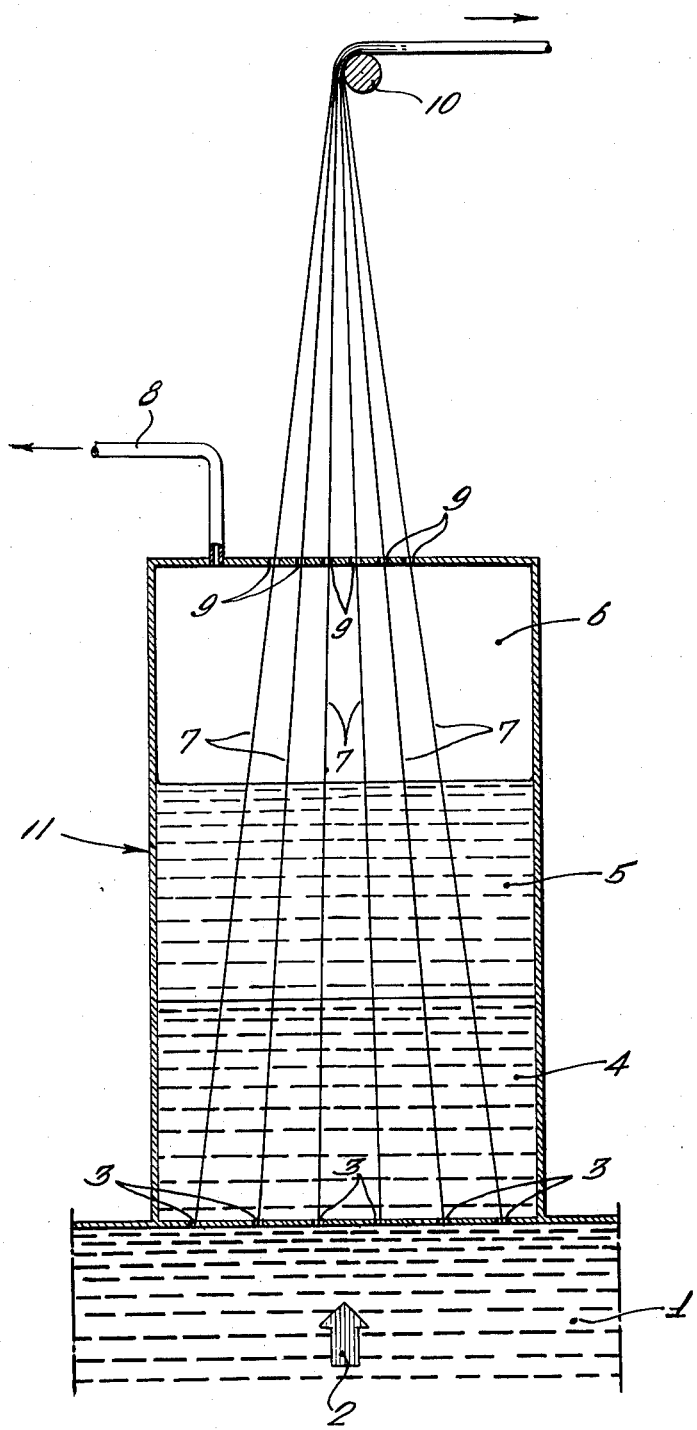
10
8
9
9
9
6
7
7
7
11
5
4
3
3
3
1
2

USE OF HOT BUOYANT LIQUID TO CONVERT PITCH TO CONTINUOUS CARBON FILAMENT

BACKGROUND OF THE INVENTION

1. Field of Invention

This invention pertains to a method for making carbon or graphite filaments from pitch. Such filaments have utility in reinforcing plastic materials. Because the filaments can have high tensile strength and stiffness their addition to thermosetting or thermoplastic materials substantially enhance the resulting physical properties of the reinforced composite. The reinforced composite has many utilities; some of which are fan blades for turbine engines, golf shafts and tennis rackets. Much of the history of preparing such filaments, their physical properties, the preparation of composites containing the fibers, their influence on properties of composites and numerous end uses for such composites is disclosed in the pamphlet, CARBON FIBERS, Design Engineering Series, Morgan-Grampian (Publishers) Ltd., England.

2. Description of the Prior Art

U.S. Pat. No. 3,716,607, issued Feb. 13, 1973, discloses a method for the production of carbon fibers from various organic substances. The method involves heating the organic substance, forming the desired shape, oxidizing the formed shape and then carbonizing the oxidized shape.

U.S. Pat. No. 3,552,922, issued Jan. 5, 1971, discloses a method for the production of carbon fibers from petroleum acid sludge. This method involves a two-step distillation of the sludge, melt spinning the distilled material, coating the melt spun material with a surface modifying agent, treating the modified coated melt spun material with an oiling agent and carbonizing the oiled material.

U.S. Pat. No. 3,629,379, issued Dec. 21, 1971, discloses a method for producing carbon filaments from a pitch containing a carbon content of 91 to 96.5 weight percent and mean molecular weight of from 400 to 2000. Described are treatments for converting pitches having other than the aforementioned carbon content and molecular weight into pitches having the desired characteristics.

U.S. Pat. No. 3,392,216, issued July 9, 1968, discloses a method for producing carbon filaments from organic substances. The method involves heating the organic substance, shaping the heated substance, oxidizing the shaped substance and then carbonizing the oxidized substance.

The foregoing patents relate to the production of carbon fibers whereas U.S. Pat. No. 3,448,185, issued June 3, 1969, is directed towards a method of melt spinning of filaments. The method, in part, involves extruding molten fiber forming polymeric material through a spinneret vertically upward through a layer of liquid metal that is in direct contact with the spinneret. Examples of the polymeric materials are polypropylene and nylon-6; the metal used is one having a freezing point lower than the boiling point of water. However, one of the problems to date is the inability to form a continuous carbon or graphite filament from pitch. A continuous carbon or graphite filament from an already formed filament of polyacrylonitrile is feasible because the heat treatment is applied to an existing filament rather than a pre-filament. Also the prior art contains processing steps, such as oxidizing, which present invention does not. Elimination of such step results in economic savings and enhances the ease of manufacturing.

SUMMARY OF THE INVENTION

Molten pitch is formed into a filament continuously and upward through a forming device located generally at the bottom of a vertical tower containing a hot buoyant liquid, e.g., LiC/KCl. The liquid buoys up the fragile filament as it ascends the tower from a lower region to an upper region wherein the temperature is maintained between the range of about 450°–700°C. As the filament emerges out of the liquid it moves through an inert zone maintained at a temperature high enough to carbonize the filament. Another inert zone can be included whereby the carbonized filament is graphitized. Present process eliminates the step referred to in the prior art as "oxidizing". It also provides a method for making a continuous filament from otherwise unworkable starting material, i.e., pitch. The liquid can be a blend of inorganic salts such as LiCl/KCl or an inorganic oxide such as thallium oxide.

DESCRIPTION OF THE DRAWING

The accompanying FIGURE is a diagrammatic representation of the invention.

DESCRIPTION

In filament technology the terms "carbon" and "graphite" are often used interchangeably and often incorrectly. However, as used herein carbon refers to products resulting from exposure to maximum heat treat temperatures usually of <1800°C. whereas graphite refers to the same but at temperatures usually of >1800°C. Filament, as used herein, refers to a long continuous individual article having extremely high length to diameter ratio. In contrast a filament can be cut across its length so that the resulting article has a modest length to diameter ratio, for example, a fiber having a one centimeter length and a 0.001 cm diameter would have an aspect ratio of 1000. Also, filament can mean several individual filaments formed into one filament; and again a fiber can be the result of cutting a filament comprising several filaments across its length.

Pitch includes petroleum pitches, coal tar pitches, natural asphalts, pitches obtained as coproduct via naphtha cracking, middle distillate cracking, gas oil cracking and fractions having high aromatic carbon content obtained from extraction processes such as furfural extraction. Petroleum processes which can produce suitable petroleum pitches include catalytic cracking, thermal cracking and visbreaking.

Among the foregoing pitches it is preferred that the forming pitch contains a carbon to hydrogen atomic ratio which favors the forming of a continuous filament in heretofore mentioned liquids. An atomic ratio which is preferred is one greater than 1.55; a more preferred one is 1.60. As the atomic ratio increases the pitch can become increasingly difficult to form and at some upper limit it is extremely difficult to form, particularly within economic limitations; one such example is where the pitch is almost completely carbon. Thus the atomic ratio range which is preferred is 1.55–2.1 and more preferred is 1.6–2.0. Atomic ratio is the weight of carbon contained in the pitch divided by its atomic weight which in turn is divided by the weight of hydrogen contained in the pitch divided by its atomic weight.

In addition to the foregoing atomic weight the softening point of the pitch influences the ease of forming the pitch into a filament. Softening point refers to the temperature when fine pitch particles begin to wet the sides of capillary tubes suspended in a heated oil bath. If the softening point is too low the pitch upon entering the liquid will become too fluid and rise to the surface of the buoyant heat transfer medium as a small discrete spherical globule without trailing a fiber behind. On the other hand if the softening point is too high the pitch is solid-like, almost impossible to form. A suitable softening point range is about 180°–440°C, a range more preferred is about 220°–380°C.

After the pitch is formed into a filament it first passes through a liquid. The liquid serves several purposes. Because of its relative density to the filament it provides support for the filament when the filament is least able to support itself. In other words the filament tends to float upward and thereby enhances the formation of a continuous filament. It also acts as a heat transfer medium which can help maintain the temperature of the filament at a given level or increase the temperature to a desired level. While serving these functions the liquid will be molten at processing temperatures which are well below its boiling point. The liquid will be a non-solvent for the pitch and have a molten density greater than that of the pitch. Because at least two layers of the liquid are used the liquid's decrease in density with increases in temperature has to be sufficient so that stratification will occur. Thus a higher temperature layer will float atop a lower temperature layer and a sharp temperature interface exists between two layers due to low thermal conductivity. Because at the elevated temperature the formed pitch, as it travels through the liquid, will generate various gases such as $CH_4$, $SO_2$, $CO_2$, etc., the liquid will be relatively chemically inert to such gases. The liquid also will have a relatively low viscosity, such a viscosity aids in the formation of a continuous filament and aids in the suppression of undesirable spheres or discontinuous fibers. A viscosity near that of water at 20°C would be satisfactory.

Among those materials found suitable are blends of inorganic salts or inorganic oxides. Generally the material will have a melting point below about 375°C and a boiling point in excess of about 750°C. A preferred range of melting points is about 200°–375°C and a more preferred range is about 250°–350°C. A preferred boiling point is excess of about 800°C. Also the material will be thermally stable, that is, it will not substantially decompose. One example of a suitable blend of inorganic salts is a LiCl/KCl eutectic (41.5 mole % KCl). The eutectic has the following properties:

| | |
|---|---|
| melting point | 354°C |
| Density | |
| at 400°C | 1.68 g/cc |
| at 500°C | 1.62 g/cc |

The properties of the components of the eutectic are as follows:

| | |
|---|---|
| viscosity | |
| LiCl at 635°C | 1.49 cp |
| KCl at 787°C | 1.14 cp |
| boiling point | |
| LiCl | 1325–60°C |
| KCl | 1500°C (sublimation) |
| vapor pressure | |
| KCl at 772°C | 0 mm |

-continued

| | |
|---|---|
| melting points | |
| LiCl | 605°C |
| KCl | 770°C |
| thermal conductivity | |
| LiCl at 670°C | $1.09 \times 10^{-3}$ cal/sec cm °C |
| KCl at 820°C | $0.86 \times 10^{-3}$ cal/sec cm °C |

An example of a suitable inorganic oxide is thallium oxide having a melting point of 300°C and while liberating oxygen at a temperature 1080°C the remaining material has a boiling point of 1870°C.

EXAMPLE

The accompanying FIGURE helps describe the method for making carbon or graphite filaments from pitch.

At the bottom of the drawing is a reservoir of pitch 1. In this example the pitch is molten. Means 2 forces the pitch through a forming device 3 located at the bottom of a tower 11 thereby forming a stream of molten carbon forming pitch. Means for forming such streams include spinnerets.

After the stream 7 is formed in, for example, a spinneret, it is in direct contact with a liquid 4, for example a LiCl/KCl eutectic. As shown the liquid is maintained in direct contact with the extrusion face of the forming device. The liquid, because of its relative density, causes the stream to pass generally vertically upward in a continuous fashion. The temperature of this layer of liquid is such that it encourages the formation of a continuous stream of molten pitch rather than the formation of undesirable fibers. Generally the temperature of this layer is in the range of about 150°–500°C.; a more operative range would be about 175°–450°C. Also the temperature of the first layer of liquid 4 is less than that of the second layer of salt 5.

Various means, such as heat exchangers, can be used to maintain the temperature of the liquid. The heat exchangers could be within the vessel, that is, immersed in the molten material. Other heat transfer systems including external heat exchangers and fluid transfer devices, would be operative.

After the formed stream 7 of molten pitch leaves the lower liquid layer 4 it continues its generally vertical upward passage into a second layer 5 of liquid, for example LiCl/KCl. Because of the relative densities the second layer, maintained at a higher temperature than the previous layer, floats atop the lower and cooler layer. Substantially no material interchange occurs between the two layers and both layers are generally motionless except for minor turbulance caused by the pitch stream travelling through the liquid. Both liquid layers are composed of the same kind of material. The temperature of this second layer is greater than that of the first layer and is between about 450°–700°C; preferably the temperatures are about 500°–650°C. During its passage through this temperature zone the hydrogen content of the pitch is substantially reduced. The reduction of hydrogen can occur by the formation of hydrogen or hydrogen containing compounds such as methane. At this temperature other materials, such as sulfur, can be forced out of the pitch. The time required for this reduction to occur depends on the thickness of the stream, the rate at which the stream flows through the liquid and other such variables. However upon leaving the second layer the pitch contains a carbon to hydrogen atomic ratio greater than about 1.88. The ratio can be as high as 2.0–2.2. However at some still higher ratio the filament could be difficult to handle and should be avoided.

After the pitch leaves the second liquid layer 5 it enters an inert atmosphere 6. Inert means that reactants such as oxygen are substantially not present. It also means that materials which would react with carbon are not present in adverse quantities. Thus a suitable atmosphere might be one consisting of nitrogen or helium. The temperature of the inert atmosphere would be in excess of about 900°–1000°C. Passage through this elevated temperature forces out most of the remaining hydrogen. With this hydrogen reduction essentially only carbon remains and the result is a carbon filament. Generally the carbon content of the filament is greater than about 95 weight percent.

Co-products, such as methane, etc., formed during the conversion of the pitch to carbon can be continuously removed from the system 8. Also as shown the carbon filaments pass through suitable opening 9 in the upper portion of the vessel. In this example several filaments are collected into one filament by suitable means 10.

A filament or collection of filaments can be converted into carbon fibers by various means.

The carbon filaments can be further treated to form a graphite filament. Thus after a carbon filament is obtained it could be exposed to an elevated temperature in excess of 2000°C. Normally the upper temperature limit would be defined by materials of construction, however, a suitable range would be about 2000°–4000°C. A temperature at this level transforms the carbon to graphite. The length of time required depends upon several variables, for example, the thickness of the filament and the rate of heating. However, after this graphite conversion step, the carbon content of the filament is more than about 99 weight percent.

One variation of the present invention is that the carbon forming step, i.e., heating in excess of about 900°–1000°C and the graphite forming step, i.e., heating in excess of about 2000°C, can be combined into one step. In other words the inert zone 6 is maintained at a temperature in excess of 2000°C.

Another alternative is the inert atmosphere zone consist of several different temperature zones. Thus the inert atmosphere zone could contain one zone maintained between about 900°–1200°C, the next zone at betweem about 1200°–1500°C, the next at 1500°–1800°C and the next at 1800°–2100°C, and etc. Also in this alternative filaments can be withdrawn from each zone so that several filaments, each having difficult chemical and physical properties, are simultaneously produced.

The invention claimed is:

1. A process for producing continuous carbon filaments comprising:

a. forming at least one stream of molten carbon forming pitch wherein resulting formed molten pitch is in contact with a liquid selected from a group consisting of a blend of molten inorganic salts and molten inorganic oxide;

b. passing the formed molten pitch stream generally vertically upward through the liquid which is maintained within a temperature range wherein the pitch forms a continuous stream;

c. continuing the generally vertically upward passage of the stream of formed molten pitch through a second liquid layer maintained between a temperature of about 450°–700°C and wherein the second liquid liquid layer is in direct contact with the first liquid layer and both layers are composed of the same material and upon leaving the second liquid layer the pitch's hydrogen content is substantially reduced; and d. after the formed pitch leaves the second liquid layer it enters an inert atmosphere maintained at a temperature in excess of about 900°–1000°C and upon leaving the inert atmosphere the previously formed pitch stream is a carbon filament.

2. Process according to claim 1 wherein the liquid has a melting point below about 375°C and a boiling point in excess of about 750°C.

3. Process according to claim 2 wherein the liquid is a LiCl/KCl eutectic.

4. Process according to claim 1 wherein the temperature of (d) is in excess of 2000°C and upon leaving the inert atmosphere the previously formed pitch stream is a graphite filament.

5. Process according to claim 1 wherein the carbon forming pitch contains a carbon to hydrogen atomic ratio of greater than 1.55.

6. Process according to claim 5 wherein the pitch is selected from the group consisting of petroleum pitch and coal pitch.

7. Process according to claim 6 wherein the pitch has a softening point within the range of about 150°–400°C.

8. Process according to claim 7 wherein the liquid has a melting point below about 375°C and a boiling point in excess of about 750°C.

9. Process according to claim 8 wherein the liquid is a LiCl/KCl eutectic.

10. Process according to claim 9 wherein the temperature of (d) is in excess of 2000°C and upon leaving the inert atmosphere the previously formed pitch stream is a graphite filament.

11. Process according to claim 1 wherein the temperature of (b) is between about 150°–500°C.

12. Process according to claim 11 wherein the pitch upon leaving the second liquid layer contains a carbon to hydrogen atomic ratio greater than 1.88.

13. Process according to claim 12 wherein the time of contacting of (d) is sufficient to remove most of the remaining hydrogen.

14. Process according to claim 13 wherein the carbon contained in the carbon filament is greater than about 95 weight percent.

15. Process according to claim 14 wherein the carbon forming pitch contains a carbon to hydrogen atomic ratio of greater than 1.55.

16. Process according to claim 15 wherein the pitch is selected from the group consisting of petroleum pitch and coal pitch.

17. Process according to claim 16 wherein the pitch has a softening point within the range of about 150°–400°C.

18. Process according to claim 16 wherein the liquid has a melting point below about 375°C and a boiling point in excess of about 750°C.

19. Process according to claim 18 wherein the liquid is a LiCl/KCl eutectic.

20. Process according to claim 1 wherein after the carbon filament is obtained, the filament is subject to an elevated temperature for a sufficient time to convert the carbon into graphite.

21. Process according to claim 20 wherein the elevated temperature is in excess of 2000°C.

22. Process according to claim 21 wherein the temperature of (b) is between about 150°–500°C.

23. Process according to claim 22 wherein the time of contacting at said temperature range of (c) is sufficient to substantially reduce the hydrogen content of the pitch.

24. Process according to claim 23 wherein the pitch upon leaving the second liquid layer contains a carbon to hydrogen atomic ratio greater than 1.88.

25. Process according to claim 24 wherein the time of contacting of (d) is sufficient to remove most of the remaining hydrogen.

26. Process according to claim 25 wherein the carbon contained in the carbon filament is greater than about 95 weight percent.

27. Process according to claim 25 wherein the filament after subjected to the elevated temperature contains more than about 99 weight percent of carbon.

28. Process according to claim 27 wherein the carbon is essentially graphite.

* * * * *